US009097107B2

(12) United States Patent
Corre et al.

(10) Patent No.: US 9,097,107 B2
(45) Date of Patent: Aug. 4, 2015

(54) SINGLE PACKER SYSTEM FOR FLUID MANAGEMENT IN A WELLBORE

(71) Applicant: Schlumberger Technology Corporation, Sugar Land, TX (US)

(72) Inventors: Pierre-Yves Corre, Eu (FR); Edward Harrigan, Richmond, TX (US); Alexander F. Zazovsky, Houston, TX (US); Stephane Briquet, Kanagawa-ken (JP); Stephen Yeldell, Sugar Land, TX (US); Carsten Sonne, Birkroed (DK); Stephane Metayer, Abbeville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/948,565

(22) Filed: Jul. 23, 2013

(65) Prior Publication Data

US 2013/0306309 A1 Nov. 21, 2013

Related U.S. Application Data

(62) Division of application No. 12/234,107, filed on Sep. 19, 2008, now Pat. No. 8,490,694.

(51) Int. Cl.
*E21B 49/10* (2006.01)
*E21B 33/12* (2006.01)
(Continued)

(52) U.S. Cl.
CPC ..... *E21B 49/10* (2013.01); *E21B 33/12* (2013.01); *E21B 33/1208* (2013.01); *E21B 37/00* (2013.01); *E21B 49/08* (2013.01); *E21B 49/081* (2013.01)

(58) Field of Classification Search
CPC ..... E21B 49/10
USPC ..... 166/100, 264, 120
See application file for complete search history.

(56) References Cited

U.S. PATENT DOCUMENTS 2,862,562 A 12/1958 Hughes
3,116,449 A * 12/1963 Vogel ..... 324/323
4,279,304 A * 7/1981 Harper ..... 166/301
(Continued)

FOREIGN PATENT DOCUMENTS

GB 2405652 A 3/2005
RU 2136856 C1 9/1999
(Continued)

OTHER PUBLICATIONS

Decision on Grant for Russian Application No. 2011115213 dated Aug. 9, 2013.

*Primary Examiner* — David Andrews
(74) *Attorney, Agent, or Firm* — Cathy Hewitt; Kenneth L. Kincaid

(57) ABSTRACT

A technique involves collecting formation fluids through a single packer having at least one drain located within the single packer. The single packer is designed with an outer structural layer that expands across an expansion zone to facilitate creation of a seal with a surrounding wellbore wall. An inflatable bladder can be used within the outer structural layer to cause expansion, and a seal can be disposed for cooperation with the outer structural layer to facilitate sealing engagement with the surrounding wellbore wall. One or more drain features are used to improve the sampling process and/or to facilitate flow through the drain over the life of the single packer.

14 Claims, 6 Drawing Sheets

(51) Int. Cl.
*E21B 49/08* (2006.01)
*E21B 37/00* (2006.01)

(56) References Cited

U.S. PATENT DOCUMENTS

| | | | | |
|---|---|---|---|---|
| 5,549,159 | A | 8/1996 | Shwe et al. | |
| 5,687,791 | A | 11/1997 | Beck et al. | |
| 6,729,398 | B2 | 5/2004 | Ringgenberg et al. | |
| 6,766,862 | B2 | 7/2004 | Chatterji et al. | |
| 6,877,559 | B2 | 4/2005 | Hashem | |
| 7,155,990 | B2 | 1/2007 | Gilbert | |
| 7,191,831 | B2 | 3/2007 | Reid et al. | |
| 7,347,262 | B2 | 3/2008 | Tarvin et al. | |
| 7,373,812 | B2 | 5/2008 | Ma et al. | |
| 7,665,537 | B2 | 2/2010 | Patel et al. | |
| 7,699,124 | B2 | 4/2010 | Corre et al. | |
| 7,874,356 | B2 * | 1/2011 | Corre et al. | 166/187 |
| 2006/0076132 | A1 * | 4/2006 | Nold et al. | 166/264 |
| 2007/0039731 | A1 | 2/2007 | Fox et al. | |
| 2007/0215348 | A1 | 9/2007 | Corre et al. | |
| 2008/0066535 | A1 | 3/2008 | Vasques et al. | |
| 2009/0159278 | A1 | 6/2009 | Corre et al. | |

FOREIGN PATENT DOCUMENTS

| | | | |
|---|---|---|---|
| RU | 2302512 | C2 | 7/2007 |
| SU | 855189 | A1 | 8/1981 |
| WO | 2005052308 | A1 | 6/2005 |
| WO | 2006067151 | A1 | 6/2006 |
| WO | 2009094410 | A2 | 7/2009 |

* cited by examiner

SINGLE PACKER SYSTEM FOR FLUID MANAGEMENT IN A WELLBORE

BACKGROUND

A variety of packers are used in wellbores to isolate specific wellbore regions. A packer is delivered downhole on a conveyance and expanded against the surrounding wellbore wall to isolate a region of the wellbore. Often, two or more packers can be used to isolate one or more regions in a variety of well related applications, including production applications, service applications and testing applications. In some applications, a straddle packer can be used to isolate a specific region of the wellbore to allow collection of fluid samples. However, straddle packers use a dual packer configuration in which fluids are collected between two separate packers. The dual packer configuration is susceptible to mechanical stresses which limit the expansion ratio and the drawdown pressure differential that can be employed. Other multiple packer techniques can be expensive and present additional difficulties in collecting samples and managing fluid flow in the wellbore environment.

SUMMARY

In general, the present invention provides a system and method for collecting formation fluids through a single packer having at least one drain located within the single packer. The single packer is designed with an outer structural layer that expands across an expansion zone to facilitate creation of a seal with a surrounding wellbore wall. An inflatable bladder can be disposed within the outer structural layer to cause expansion, and a seal can be disposed for cooperation with the outer structural layer to facilitate sealing engagement with the surrounding wellbore wall. One or more drain features are used to improve the sampling process and/or to facilitate flow through the drain over the life of the single packer.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for collecting formation fluids through a drain located in a single packer. The collected formation fluids are conveyed along an outer structural layer of the packer to a flow line and then directed to a desired collection location. Use of the single packer enables larger expansion ratios and higher drawdown pressure differentials. Additionally, the single packer configuration reduces the stresses otherwise incurred by the packer tool mandrel due to the differential pressures. In some embodiments, the packer uses a single expandable sealing element which renders the packer better able to support the formation in a produced zone at which formation fluids are collected. This quality facilitates relatively large amplitude draw-downs even in weak, unconsolidated formations.

The single packer expands across an expansion zone, and formation fluids can be collected from the middle of the expansion zone, i.e. between axial ends of the outer sealing layer. The formation fluid collected is directed along flow lines, e.g. along flow tubes, having sufficient inner diameter to allow operations in relatively heavy mud. Formation fluid can be collected through one or more drains. For example, separate drains can be disposed along the length of the packer to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

The single packer incorporates or cooperates with a variety of features to improve efficiency of the sampling operation and to facilitate flow through packer drains over the life of the single packer. For example, the single packer may incorporate surrounding edges arranged around the drains to prevent extrusion of a seal layer. Additionally, individual seal members may be mounted around each drain, or an overall seal layer can be constructed with passages to enable fluid communication between specific groups of drains. The configuration of the single packer also enables cleaning of wellbore regions by creating inward or outward fluid flows through the drains to remove material that would otherwise interfere with well fluid in sampling operations. A variety of other features can be incorporated into the single packer to facilitate a variety of sampling operations, to make the packer more reliable and more efficient, and to enhance the life of the packer.

Figure 1:
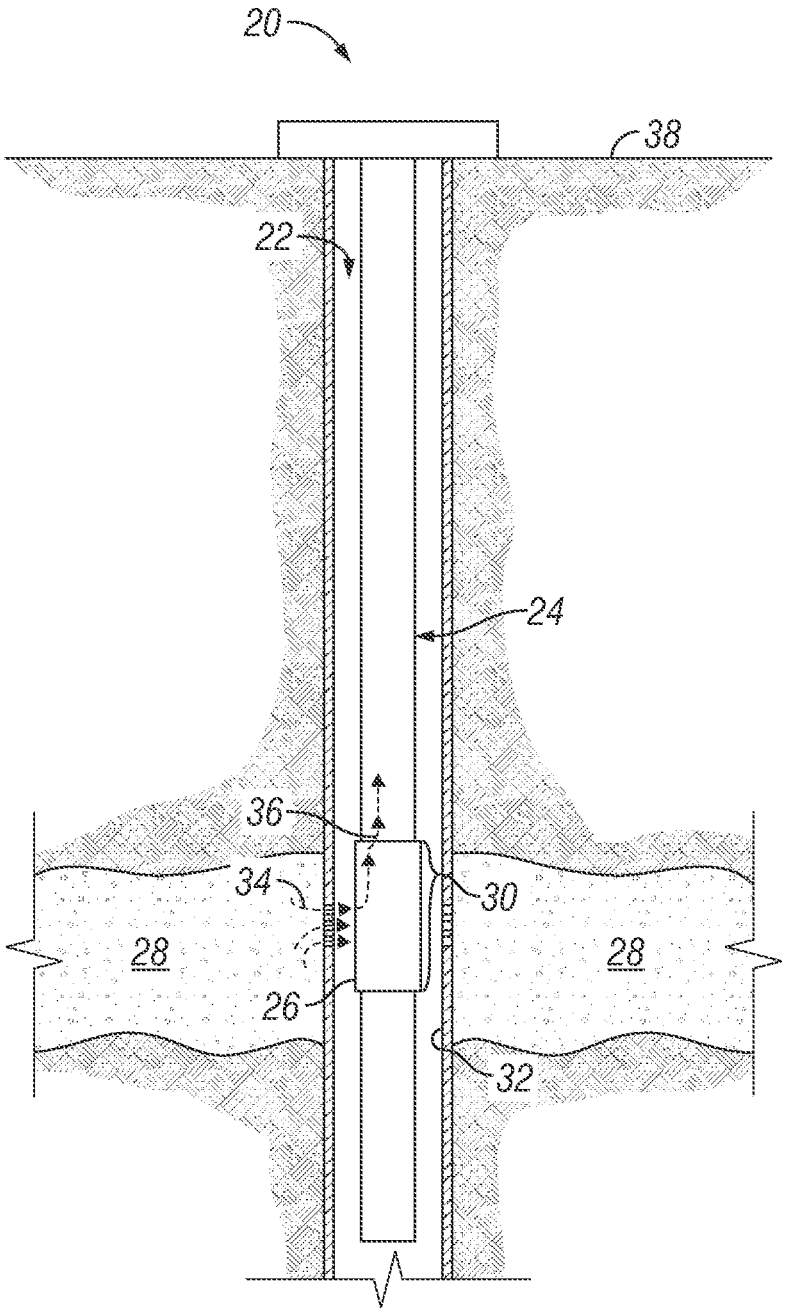
FIG. 1 is a schematic front elevation view of a well system having a single packer through which formation fluids can be collected, according to an embodiment of the present invention.

Referring generally to FIG. 1, one embodiment of a well system 20 is illustrated as deployed in a wellbore 22. The well system 20 comprises a conveyance 24 employed to deliver at least one packer 26 downhole. In many applications, packer 26 is deployed by conveyance 24 in the form of a wireline, but conveyance 24 may have other forms, including tubing strings, for other applications. In the embodiment illustrated, packer 26 is a single packer configuration used to collect formation fluids from a surrounding formation 28. The packer 26 is selectively expanded in a radially outward direction to seal across an expansion zone 30 with a surrounding wellbore wall 32, such as a surrounding casing or open wellbore wall. When packer 26 is expanded to seal against wellbore wall 32, formation fluids can be flowed into packer 26, as indicated by arrows 34. The formation fluids are then directed to a flow line, as represented by arrows 36, and produced to a collection location, such as a location at a well site surface 38, or in sampling bottles in a conveyance tool.

Figure 2:
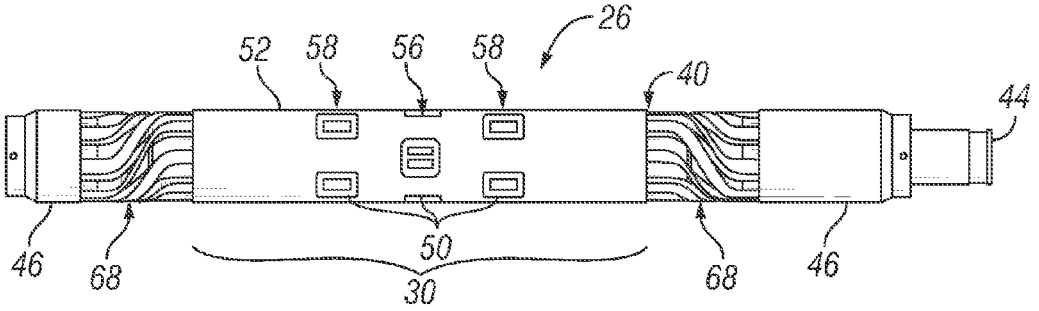
FIG. 2 is a front view of one example of the single packer illustrated in FIG. 1, according to an embodiment of the present invention.
Figure 3:
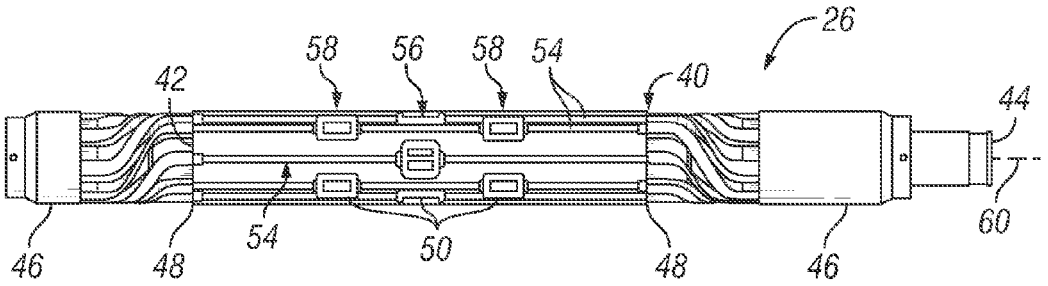
FIG. 3 is a view similar to that of FIG. 2 but showing internal components of an outer structural layer, according to an embodiment of the present invention.

Referring generally to FIGS. 2 and 3, one embodiment of single packer 26 is illustrated. In this embodiment, packer 26 comprises an outer structural layer 40 that is expandable in a wellbore to form a seal with surrounding wellbore wall 32 across expansion zone 30. The packer 26 further comprises an inner, inflatable bladder 42 disposed within an interior of outer structural layer 40. The inflatable bladder 42 can be formed in several configurations and with a variety of materials, such as a rubber layer having internal cables. In one example, the inner bladder 42 is selectively expanded by fluid delivered via an inner mandrel 44. Furthermore, packer 26 comprises a pair of mechanical fittings 46 that are mounted around inner mandrel 44 and engaged with axial ends 48 of outer structural layer 40.

Outer structural layer 40 may comprise one or more drains 50 through which formation fluid is collected when outer layer 40 is expanded to seal the single packer 26 against surrounding wellbore wall 32. Drains 50 may be embedded radially into a sealing element or seal layer 52 that surrounds outer structural layer 40. By way of example, sealing layer 52 may be cylindrical and formed of an elastomeric material selected for hydrocarbon based applications, such as a rubber material.

A plurality of tubular members or tubes 54 can be operatively coupled with drains 50 for directing the collected formation fluid in an axial direction to one or both of the mechanical fittings 46. In one example, alternating tubes 54 are connected either to a central drain or drains, e.g. sampling drains 56, or to axially outer drains, e.g. guard drains 58, located on both axial sides of the middle sampling drains. The guard drains 58 can be located around the sampling drains 56 to achieve faster fluid cleaning during sampling. As further illustrated in FIG. 3, tubes 54 can be aligned generally parallel with a packer axis 60 that extends through the axial ends of outer structural layer 40. The tubes 54 may be at least partially embedded in the material of sealing element 52 and thus move radially outward and radially inward during expansion and contraction of outer layer 40.

Figure 4:
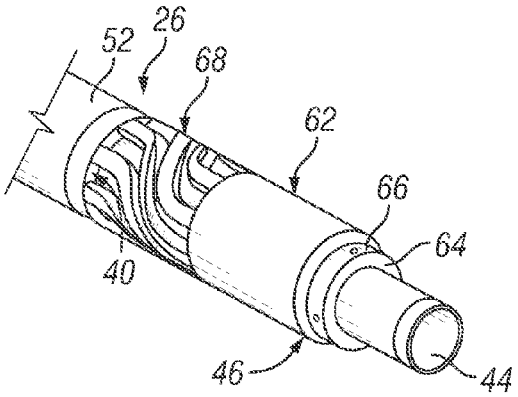
FIG. 4 is an orthogonal view of an end of the packer illustrated in FIG. 2 in a contracted configuration, according to an embodiment of the present invention.
Figure 5:
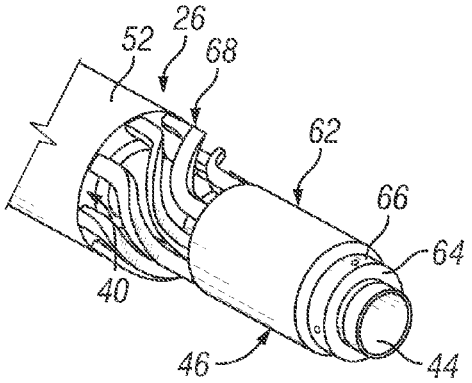
FIG. 5 is an orthogonal view similar to that of FIG. 4 but showing the packer in an expanded configuration, according to an embodiment of the present invention.

Referring generally to FIGS. 4 and 5, an embodiment of mechanical fittings 46 is illustrated in both a contracted configuration (FIG. 4) and an expanded configuration (FIG. 5). In this embodiment, each mechanical fitting 46 comprises a collector portion 62 having an inner sleeve 64 and an outer sleeve 66 that are sealed together. Each collector portion 62 can be ported as desired to deliver fluid collected from the surrounding formation to a desired flow system, as described in greater detail below. One or more movable members 68 are movably coupled to each collector portion 62, and at least some of the movable members 68 are used to transfer collected fluid from tubes 54 into the collector portion 62. By way of example, each movable member 68 may be pivotably coupled to its corresponding collector portion 62 for pivotable movement about an axis generally parallel with packer axis 60.

In the embodiment illustrated, a plurality of movable members 68 are pivotably mounted to each collector portion 62. At least some of the movable members 68 are designed as flow members that allow fluid flow between tubes 54 and collector portions 62. Certain movable flow members 68 can be coupled to tubes 54 extending to sampling drains 56, while other movable flow members 68 can be coupled to tubes 54 extending to guard drains 58 to enable separation of guard drain flow and sampling drain flow. In this example, movable flow members 68 are generally S-shaped and designed for pivotable connection with both the corresponding collector portion 62 and the corresponding tubes 54. As a result, members 68 can be pivoted between the contracted configuration illustrated in FIG. 4 and the expanded configuration illustrated in FIG. 5.

Figure 6:
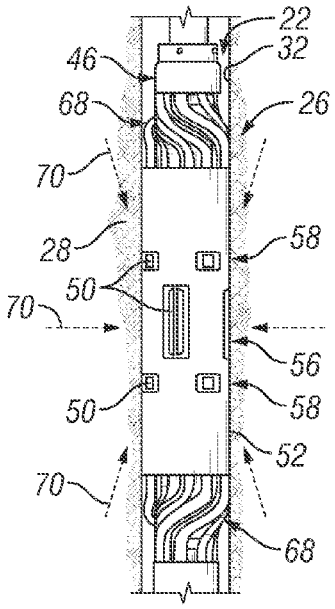
FIG. 6 is an illustration of one embodiment of the single packer expanded in a wellbore to collect fluid samples, according to an embodiment of the present invention.

Referring generally to FIG. 6, single packer 26 is illustrated as expanded in wellbore 22 for a sampling operation. During the sampling operation, well fluid is drawn from the surrounding formation 28 in through sampling drains 56 and guard drains 58 as indicated by arrows 70. By way of example, contaminated fluid is first collected through all of the drains 50 until clean fluid reaches the sampling drains 56. The guard drains 58 are used to continue drawing in well fluid that may be contaminated to help enable the collection of clean fluid samples through sampling drains 56 during a focused sampling operation.

Figure 7:
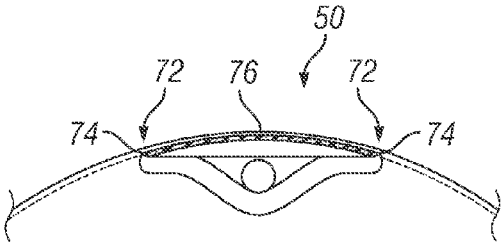
FIG. 7 is a schematic illustration of one example of a drain feature to facilitate flow through a drain, according to an embodiment of the present invention.

Individual drains may comprise or cooperate with a drain feature 72 designed to enhance sampling efficiency and to facilitate flow through the corresponding drain over the life of the single packer 26. The drain features 72 may be utilized at all drains 50 or at selected drains. By way of example, drain feature 72 may comprise a surrounding edge 74 arranged around each drain 50 to prevent extrusion of seal layer 52 between the drain and the wellbore wall, as illustrated in FIG. 7. The surrounding edge 74 can be a sharp edge designed to penetrate into, e.g. deform, the surrounding formation or other wellbore wall when single packer 26 is inflated. The engagement of the surrounding edge 74 with the wellbore wall eliminates any clearance that otherwise could allow extrusion of seal layer 52 when drawdown pressure is applied.

In the example illustrated in FIG. 7, a sand screen 76 is positioned over drain 50 to prevent the intrusion of particulates into the drain.

Figure 8:
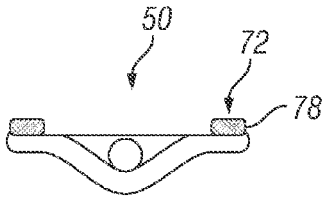
FIG. 8 is a schematic illustration of another drain feature to facilitate flow through a drain, according to an alternate embodiment of the present invention.
Figure 9:
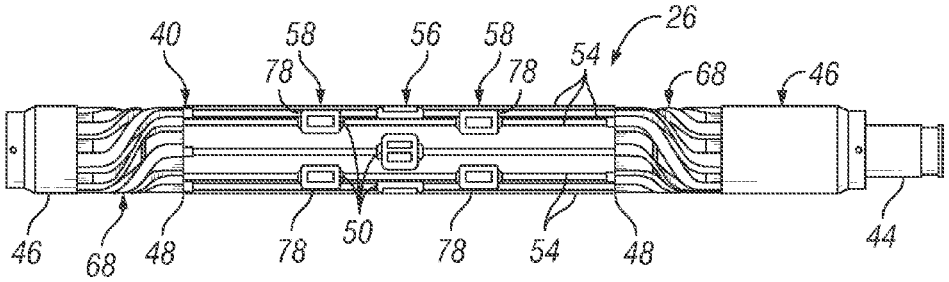
FIG. 9 is a front view of a single packer incorporating a plurality of the drain features illustrated in FIG. 8, according to an embodiment of the present invention.

Another embodiment of drain feature 72 is illustrated in FIG. 8. In this embodiment, the drain feature 72 comprises an individual seal 78 deployed around the corresponding drain 50. In some embodiments, individual seals 78 can be deployed around all of the sampling drains and guard drains. The individual seals 78 are squeezed against the surrounding wellbore wall 32 when the single packer 26 is inflated to the expanded configuration. Seals 78 ensure the efficient flow of fluid through drains 50 during sampling procedures. In some applications, the individual seals can be used to eliminate or reduce the size of seal layer 52, as illustrated in the embodiment of FIG. 9. In FIG. 9, individual seals 78 are deployed around each sampling drain 56 and each guard drain 58 to form a secure seal with the surrounding wellbore wall without additional seal layer material. The individual seals 78 may be formed of an elastomeric material selected for hydrocarbon based applications, such as a rubber material.

Figure 10:
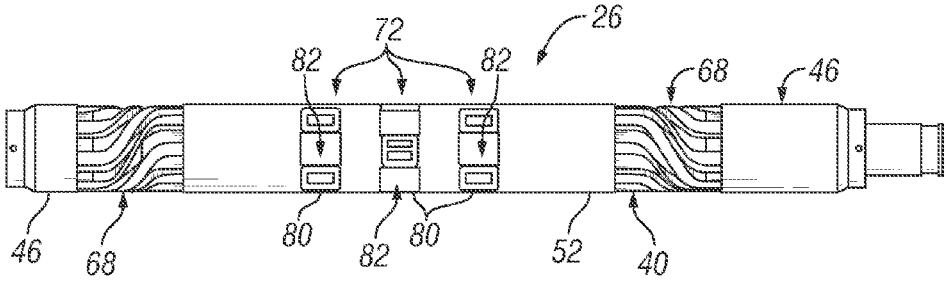
FIG. 10 is a front view of another embodiment of the single packer incorporating an alternate drain feature, according to an alternate embodiment of the present invention.

Referring generally to FIG. 10, another embodiment of drain feature 72 is illustrated. In this embodiment, the sealing of outer seal layer 52 is optimized to maximize drain efficiency by connecting groups of specific drains. For example, the outer seal layer 52 can be designed to avoid any sealing between the sampling drains 56. The outer seal layer 52 also can be designed to avoid sealing between each axial group of guard drains 58, as illustrated in FIG. 10. As illustrated, the outer seal layer 52 is formed with one or more passages 80 that enable fluid communication along the outer seal layer between groups of specific drains selected from the total number of drains 50. In some embodiments, the passages 80 along outer seal layer 52 can be filled with a porous material 82 that allows fluid flow between the drains of a specific group. By way of example, the porous material 82 may comprise a porous and incompressible material, such as a ceramic material, e.g. ceramic balls, set at a surface of seal layer 52 to create passages 80 when single packer 26 is expanded against the surrounding wellbore wall.

Figure 11:
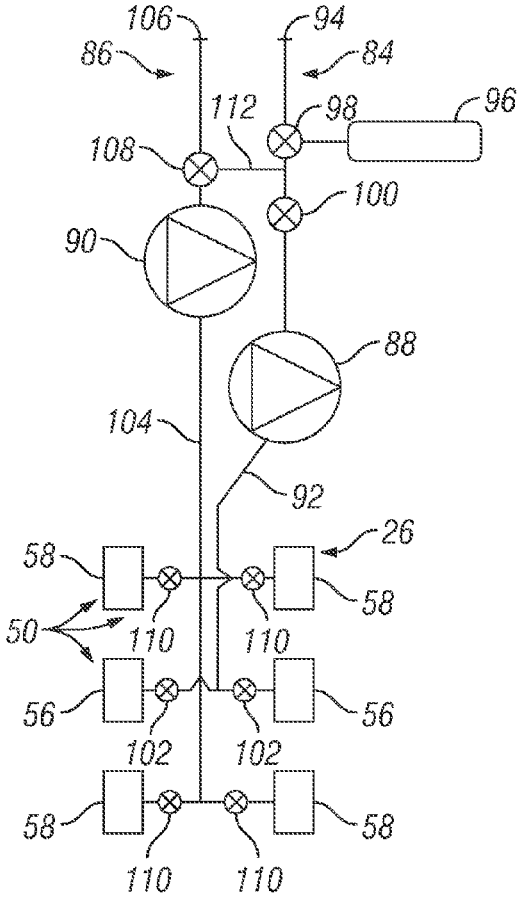
FIG. 11 is a schematic illustration of a flow system coupled to a plurality of single packer drains, according to an embodiment of the present invention.

As illustrated in FIG. 11, the sampling drains 56 and the guard drains 58 can be coupled to a sampling drain flow system 84 and a guard drain flow system 86, respectively. In this embodiment, the sampling drain flow system 84 comprises a pump 88, and the guard drain flow system 86 comprises a separate pump 90. The sampling drain flow system 84 is connected to sampling drains 56 via a flow line 92 having a flow line outlet 94 on an opposite side of pump 88 from the sampling drains 56. A sampling bottle 96 is connected to flow line 92 via a valve 98, and a second valve 100 may be positioned in flow line 92 between sampling bottle 96 and pump 88. Optional valves 102 also may be positioned in flow system 84 proximate each sampling drain 56 to enable isolation of individual sampling drains.

The guard drain flow system 86 similarly comprises a guard drain flow line 104 connected to the guard drains 58. The flow line 104 extends from guard drains 58 to a flow line outlet 106 on an opposite side of pump 90. A valve 108 is positioned in flow line 104 between pump 90 and outlet 106. Optional valves 110 also may be positioned in flow system 86 proximate each guard drain 58 to enable isolation of individual guard drains. In the embodiment illustrated, a crossover flow line 112 also is connected between guard drain flow system 86 and sampling drain flow system 84 to allow continued fluid sampling procedures in the event flow line 92 fails to function properly. In this latter scenario, the fluid samples can be collected through flowlines 104. Crossover flow line 112 can be coupled with guard drain flow system 86 via valve 108 and with sampling drain flow system 84 between valves 98 and 100.

A variety of procedures can be performed via single packer 26 in cooperation with flow systems 84 and 86 by operating the pumps and valves in selected operational states. Some examples of procedures/operational phases of a sampling operation are provided as follows:

| Phase | Pump 90 | Valve 108 | Pump 88 | Valve 98 | Valve 100 |
|---|---|---|---|---|---|
| Formation cleaning | Pumping | Opens outlet 106 | Pumping | Opens outlet 94 | Open |
| Sampling | Pumping | Opens outlet 106 | Pumping | Opens sampling bottles. Closes outlet 94 | Open |
| Formation cleaning/guard flowline failed | Inactive | Opens outlet 106 | Pumping | Opens outlet 94 | Open |
| Sampling/guard flowline failed | Inactive | Opens outlet 106 | Pumping | Opens sampling bottle. Closes outlet 94 | Open |
| Formation cleaning/sampling flowline failed | Pumping | Closes outlet 106/ Connects guard flowlines to sampling flowlines | Inactive | Opens outlet 94 | Closed |
| Formation Sampling/sampling flowline failed | Pumping | Closes outlet 106/ Connects guard flowlines to sampling flowlines | Inactive | Opens sampling bottles. Closes outlet 94 | Closed |
| Flowlines cleaning | Reverse pumping | Opens outlet 106 | Reverse pumping | Opens outlet 94 | Open |
| Mudcake collection in bottle (if needed) | Pumping | Closes outlet 106/ Connects guard flowlines to sampling flowlines | Inactive | Opens sampling bottles. Closes outlet 94 | Closed |
| Packer stuck. Reverse pumping to help packer | Reverse pumping | Opens outlet 106 | Reverse pumping | Opens outlet 94 | Open |

Additionally, the isolation valves 102, 110 can be operated to selectively isolate sampling drains 56 and/or guard drains 58 if necessary. For example, a given sampling operation can be initiated by successively opening each drain 56, 58 and recording the pressure response of the single packer 26. If a substantial pressure increase occurs after the opening of an individual drain, a leak is indicated and the specific drain can be closed or isolated via the appropriate isolation valves 102 or 110. The sampling operation can then be continued with the remaining operational drains.

Figure 12:
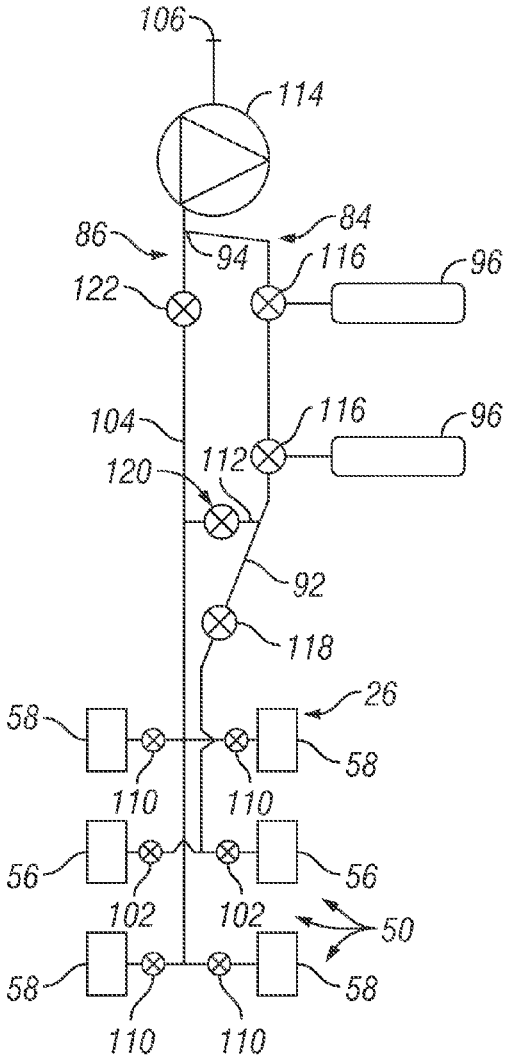
FIG. 12 is a schematic illustration of another embodiment of a flow system coupled to a plurality of single packer drains, according to an alternate embodiment of the present invention.

An alternate embodiment is illustrated in FIG. 12. In this embodiment, a single pump 114 is used for both sampling drain flow system 84 and guard drain flow system 86. The embodiment illustrated in FIG. 12 is similar to the embodiment of FIG. 11 with a few changes. For example, the sampling drain flow system 84 is illustrated with a pair of sampling bottles 96 coupled with flow line 92 via valves 116. Another valve 118 is positioned in flow line 92 between sampling drains 56 and the first or lower valve 116. Additionally, the outlet 94 of flow line 92 is connected to flow line 104 of guard drain flow system 86 between guard drains 58 and pump 114. The crossover line 112 is connected between flow line 104 and flow line 92 with a valve 120 located in the crossover line 112. Additionally, a valve 122 is positioned in flow line 104 between the locations at which crossover line 112 and outlet 94 join flow line 104.

The embodiment illustrated in FIG. 12 also enables a variety of procedures to be performed via single packer 26 in cooperation with flow systems 84 and 86 by operating the pumps and valves in selected operational states. Some examples of procedures/operational phases of a sampling operation are provided as follows:

| Phase | Pump 114 | Valve 122 | Valve 116 | Valve 118 | Valve 120 |
|---|---|---|---|---|---|
| Formation cleaning/ flowlines OK | Pumping | Opened | Close bottle/connects to pump | Opened | Closed |
| Sampling/flowlines OK | Pumping | Opened | Opens sampling bottles. Closes connection to pump | Opened | Closed |
| Formation cleaning/ guard flowline failed | Pumping | Closed | Close bottle/connects to pump | Opened | Closed |
| Sampling/guard flowline failed | Pumping | Closed | Opens sampling bottles. Closes connection to pump | Opened | Closed |
| Formation cleaning/ sampling flowline failed | Pumping | Closed | Close bottle/connects to pump | Closed | Opened |
| Formation Sampling/ sampling flowline failed | Pumping | Closed | Opens sampling bottles. Closes connection to pump | Closed | Opened |
| Flowlines cleaning | Reverse pumping | Opened | Close bottle/connects to pump | Opened | Opened |
| Mudcake collection in bottle (if needed) | Pumping | Closed | Opens sampling bottles. Closes connection to pump | Closed | Opened |
| Packer stuck. Reverse pumping to help packer deflation | Reverse pumping | Opens outlet 106 | Opens outlet 94 | Opened | Opened |

Figure 13:
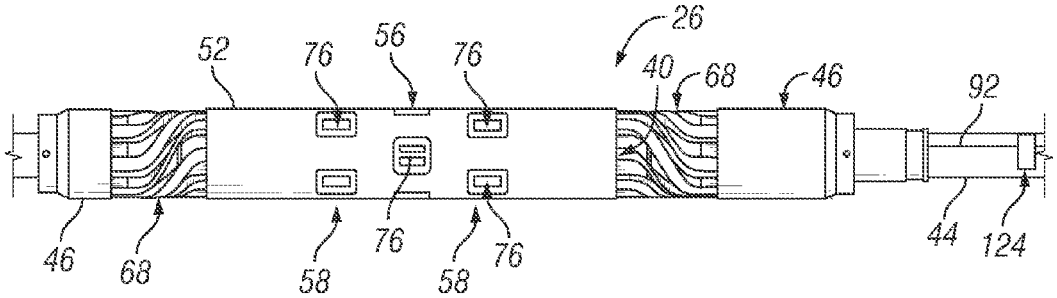
FIG. 13 is a front view of one example of a single packer incorporating sand screens, according to an embodiment of the present invention.

In some applications, single packer 26 incorporates filtering mechanisms to filter solids, such as mud/sand or other particulates from the incoming well fluid. As illustrated in FIG. 13, the single packer 26 may incorporate multiple sand screens 76 over individual drains 50. However, sand screens can be positioned at other locations to filter fluid flowing into the plurality of drains 50. For example, one or more sand screens 124 may be positioned along flow lines 92, 104; in collectors 62; or at other locations along the flow path. Placement of sand screens 76 in drains 50 saves space and reduces the risk of tubes plugging. In some applications, the sand screens can be cleaned by, for example, use of high-frequency vibrations directed through the flowlines and drains. In other applications, the placement of sand screens 124 in collectors 62 may be useful because of the substantial space available within collectors 62.

Figure 14:
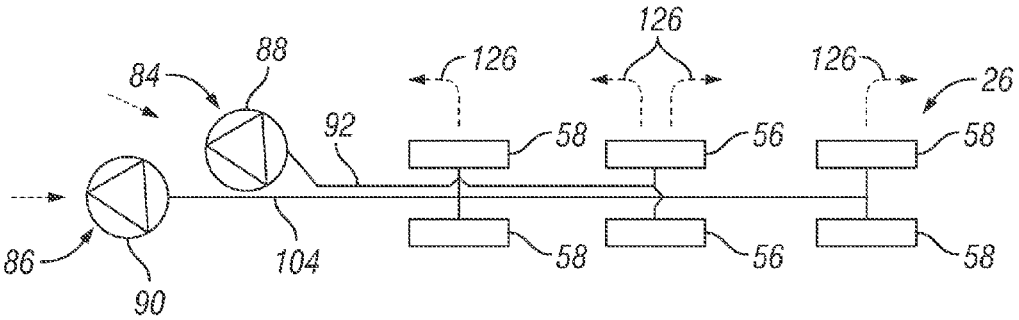
FIG. 14 is a schematic illustration of a cleaning procedure utilizing the packer drains, according to an embodiment of the present invention.

In many applications, the single packer 26 can be used to clean regions of wellbore 22 by flushing well fluid through the drains 50. In one embodiment, the cleaning is performed prior to sampling of the fluid. This allows for the performance a fluid analysis, while reducing the risk of plugging filters. As illustrated in FIG. 14, pumps 88, 90 or pump 114 can be used to deliver fluid downhole to the drains 50 and outwardly into the surrounding wellbore region as illustrated by arrows 126. Fluid can be flushed through both the sampling drains and the guard drains to dissolve and remove mud and other unwanted material from the wellbore region. In some applications, it can be helpful to first apply a pressure drawdown to break the mud cake before flushing with fluid to remove the mud.

Figure 15:
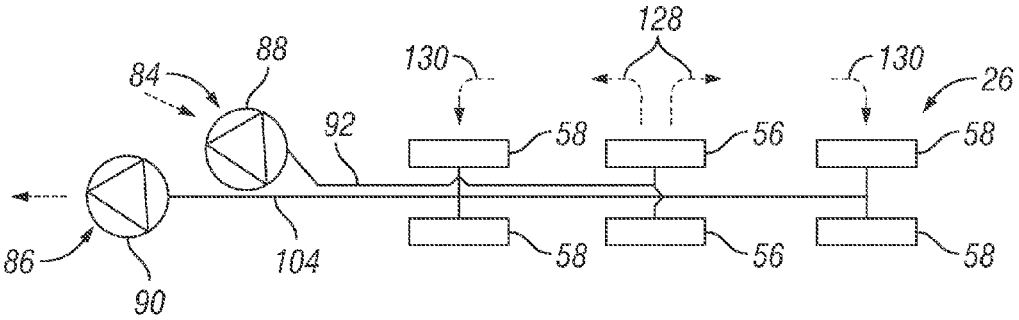
FIG. 15 is a schematic illustration of another cleaning procedure utilizing the packer drains, according to an alternate embodiment of the present invention.
Figure 16:
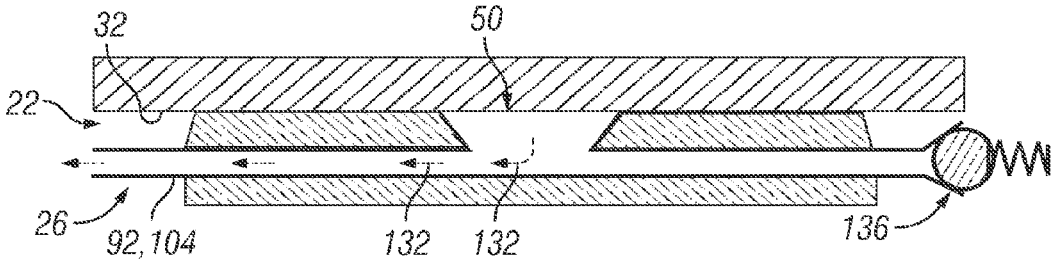
FIG. 16 is a schematic illustration of an operation utilizing the single packer to break mud cake along a wellbore, according to an embodiment of the present invention.
Figure 17:
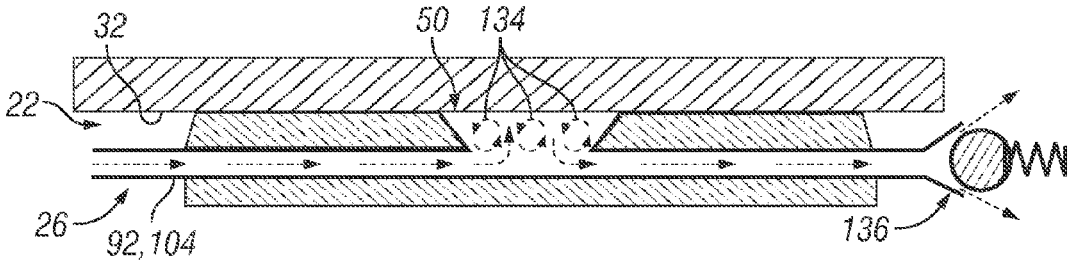
FIG. 17 is an illustration similar to that of FIG. 16 but showing the flushing of mud material, according to an embodiment of the present invention.
Figure 18:
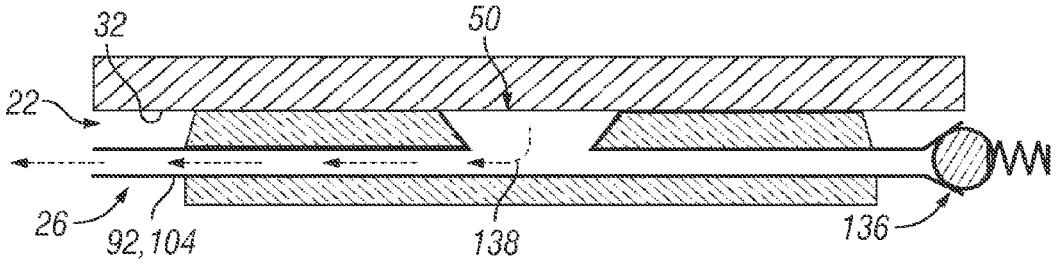
FIG. 18 is an illustration similar to that of FIG. 16 but showing the taking of a well fluid sample, according to an embodiment of the present invention.

Alternatively, flushing fluid can be delivered through one flow system and removed through another, as illustrated in FIG. 15. In this embodiment, flushing fluid is delivered into the wellbore through the sampling drains 56, as illustrated by arrows 128. The flushing fluid mixes with mud and is drawn into guard drains 58, as illustrated by arrows 130. The cleaning phase is accomplished by establishing fluid circulation between the sampling drains and the guard drains. It should be noted that the flushing fluid also can be delivered to the wellbore region through the guard drains and circulated back into the sampling drains. Removal of the mud also can be facilitated by injecting chemicals via the flushing fluid to help dissolve the mud cake. For example, acids, solvents, anti-dispersing products, and other chemicals can be injected to help increase sampling efficiency by dissolving the mud cake and lowering plugging risks when drawdown is applied In some applications, sampling efficiency can be improved by creating an initial pressure drawdown to break the mudcake for removal prior to sampling. As illustrated in FIG. 16, for example, single packer 26 is initially expanded, e.g. inflated, against the surrounding wellbore wall 32 and a drawdown pressure is applied to break the mud cake at drains 50, as illustrated by arrows 132. Once the mud cake is broken loose, flushing fluid can be flowed down through the appropriate flow line to the one or more drains 50. The flushing fluid mixes with the mud and other debris, as illustrated by arrows 134, and pressure in the flowline causes the mixture to discharge through a check valve 136, as further illustrated in FIG. 17. Subsequently, a negative pressure is applied to collect fluid samples from the formation, as illustrated by arrow 138 in FIG. 18. The negative pressure also closes check valve 136 and allows continued sampling of formation fluid with reduced risk of filter plugging.

Figure 19:
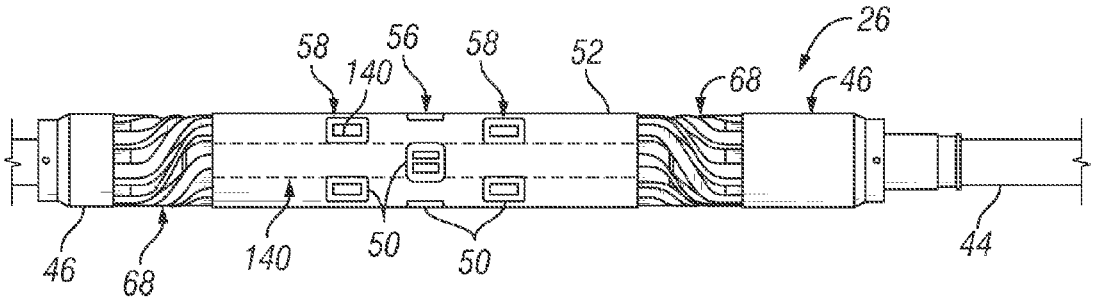
FIG. 19 is a front view of another example of the single packer, according to an alternate embodiment of the present invention.

Single packer 26 also can be constructed with portions 140 of flowlines embedded in outer seal layer 52 to facilitate pressure equalization after inflation of the packer, as illustrated in FIG. 19. By setting the flowlines within the rubber (or other) material of the seal layer, the single packer is better able to equalize pressures at both extremities of the packer when inflated. The configuration reduces axial force applied on the packer structure due to pressure differentials.

As described above, well system 20 may be constructed in a variety of configurations for use in many environments and applications. The single packer 26 may be constructed from a variety of materials and components for collection of formation fluids from single or multiple intervals within a single expansion zone. The ability to expand a sealing element across the entire expansion zone enables use of packer 26 in a wide variety of well in environments, including those having weak unconsolidated formations. The various drain features and flow system arrangements also can be constructed in several arrangements to provide a more reliable and efficient single packer design.

In any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%. Components suitable for the rubbers described in this paragraph include, but are not limited to, inner inflatable bladder 42, sealing layer 52, and individual seal(s) 78.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method, comprising:

providing a single expandable packer comprising:

a first plurality of guard drains collectively disposed at a first axial position relative to the single expandable packer;

a second plurality of guard drains collectively disposed at a second axial position relative to the single expandable packer, wherein the second axial position is axially offset from the first axial position; and a plurality of sample drains collectively disposed at a third axial position relative to the single expandable packer, wherein the third axial position is axially between the first and second axial positions;

delivering the single expandable packer downhole into a wellbore;

expanding the single expandable packer against a surrounding wellbore wall, whereby the first plurality of guard drains, the second plurality of guard drains, and the plurality of sample drains collectively contact the wellbore wall at a plurality of different radial positions spaced around a substantial portion of the circumference of the wellbore wall;

operating a pumping system to draw well fluid in through the first plurality of guard drains, the second plurality of guard drains, and the plurality of sample drains; and removing mud cake from each of a plurality of regions of the wellbore wall prior to sampling via the single expandable packer.

2. The method of claim 1 wherein removing mud cake comprises flushing fluid though each of the plurality of sample drains.

3. The method of claim 2 wherein removing mud cake further comprises circulating fluid between ones of the plurality of sample drains and ones of the first and/or second pluralities of guard drains.

4. The method of claim 2 wherein removing mud cake comprises:

delivering fluid into the wellbore through ones of the plurality of sample drains; and drawing fluid from the wellbore through ones of the first and second pluralities of guard drains.

5. The method of claim 2 wherein removing mud cake comprises:

delivering fluid into the wellbore through ones of the first and second pluralities of guard drains; and drawing fluid from the wellbore through ones of the plurality of sample drains.

6. The method of claim 1 wherein removing mud cake comprises drawing down pressure through at least one of the plurality of sample drains to break loose the mud cake after expanding the single expandable packer.

7. The method of claim 1 wherein removing mud cake comprises injecting chemicals downhole to dissolve the mud cake.

8. The method of claim 1 wherein the single expandable packer further comprises an outer seal layer formed with:

a first passage fluidly coupling each of the first plurality of guard drains;

a second passage fluidly coupling each of the second plurality of guard drains; and a third passage fluidly coupling each of the plurality of sample drains.

9. The method of claim 8 wherein each of the first, second, and third passages comprises a porous material that allows fluid flow therein.

10. The method of claim 1 wherein the single expandable packer further comprises:

a guard drain flow system comprising a first pump operable to draw fluid into each of the first plurality of guard drains and each of the second plurality of guard drains; and a sample drain flow system comprising a second pump operable to draw fluid into each of the plurality of sample drains.

11. The method of claim 10 wherein the single expandable packer further comprises a crossover flow line connected between the guard drain flow system and the sample drain flow system and operable to allow continued fluid sampling procedures in the event a portion of the sample drain flow system fails to function properly.

12. A method, comprising:

providing a single expandable packer comprising:

a first plurality of guard drains collectively disposed at a first axial position relative to the single expandable packer;

a second plurality of guard drains collectively disposed at a second axial position relative to the single expandable packer, wherein the second axial position is axially offset from the first axial position;

a plurality of sample drains collectively disposed at a third axial position relative to the single expandable packer, wherein the third axial position is axially between the first and second axial positions;

an outer seal layer formed with:

a first passage fluidly coupling each of the first plurality of guard drains;

a second passage fluidly coupling each of the second plurality of guard drains; and a third passage fluidly coupling each of the plurality of sample drains, wherein each of the first, second, and third passages comprises a porous material that allows fluid flow therein;

a guard drain flow system comprising a first pump operable to draw fluid into each of the first plurality of guard drains and each of the second plurality of guard drains;

a sample drain flow system comprising a second pump operable to draw fluid into each of the plurality of sample drains; and a crossover flow line connected between the guard drain flow system and the sample drain flow system and operable to allow continued fluid sampling procedures in the event a portion of the sample drain flow system fails to function properly;

delivering the single expandable packer downhole into a wellbore;

expanding the single expandable packer against a surrounding wellbore wall, whereby the first plurality of guard drains, the second plurality of guard drains, and the plurality of sample drains collectively contact the wellbore wall at a plurality of different radial positions spaced around a substantial portion of the circumference of the wellbore wall;

operating a pumping system to draw well fluid in through the first plurality of guard drains, the second plurality of guard drains, and the plurality of sample drains;

removing mud cake from each of a plurality of regions of the wellbore wall by:

drawing down pressure through at least one of the plurality of sample drains to break loose the mud cake after expanding the single expandable packer; and circulating fluid between ones of the plurality of sample drains and ones of the first and/or second pluralities of guard drains.

13. The method of claim 12 wherein circulating fluid between ones of the plurality of sample drains and ones of the first and/or second pluralities of guard drains comprises:

delivering fluid into the wellbore through ones of the plurality of sample drains; and drawing fluid from the wellbore through ones of the first and second pluralities of guard drains.

14. The method of claim 12 wherein circulating fluid between ones of the plurality of sample drains and ones of the first and/or second pluralities of guard drains comprises:

delivering fluid into the wellbore through ones of the first and second pluralities of guard drains; and drawing fluid from the wellbore through ones of the plurality of sample drains.

* * * * *